US010937449B2

(12) United States Patent
Lecomte et al.

(10) Patent No.: US 10,937,449 B2
(45) Date of Patent: Mar. 2, 2021

(54) APPARATUS AND METHOD FOR DETERMINING A PITCH INFORMATION

(71) Applicant: Fraunhofer-Gesellschaft zur Foerderung der angewandten Forschung e.V., Munich (DE)

(72) Inventors: Jérémie Lecomte, Erlangen (DE); Adrian Tomasek, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 158 days.

(21) Appl. No.: 16/375,323

(22) Filed: Apr. 4, 2019

(65) Prior Publication Data

US 2019/0228794 A1 Jul. 25, 2019

Related U.S. Application Data

(63) Continuation of application No. PCT/EP2017/074984, filed on Oct. 2, 2017.

(30) Foreign Application Priority Data

Oct. 4, 2016 (EP) ..... 16192253

(51) Int. Cl.
*G10L 25/90* (2013.01)

(52) U.S. Cl.
CPC ..... *G10L 25/90* (2013.01)

(58) Field of Classification Search
CPC ..... G10L 19/08; G10L 19/09; G10L 25/90
See application file for complete search history.

(56) References Cited

U.S. PATENT DOCUMENTS 5,867,814 A * 2/1999 Yong ..... G10L 19/10 704/216
5,930,747 A * 7/1999 Iijima ..... G10L 25/90 704/207

(Continued)

FOREIGN PATENT DOCUMENTS

EP 0628947 A1 12/1994
EP 0628947 B1 12/1994

(Continued)

OTHER PUBLICATIONS

Fujisaki, Hiroya, et al., "A method for automatic pitch extraction of speech signal using autocorrelation functions through delay time proportional window-length", The Institute of Electronics International and Communication Engineers (IEICE) research report. vol. 90, No. 445., p. 9-16.

(Continued)

*Primary Examiner* — Daniel Abebe
(74) *Attorney, Agent, or Firm* — Perkins Coie LLP; Michael A. Glenn

(57) ABSTRACT

An apparatus for determining a pitch information on the basis of an audio signal. The apparatus is configured to obtain a similarity value being associated with a given pair of portions of the audio signal having a given time shift, wherein the apparatus is configured to choose a length of signal portions of the audio signal used to obtain the similarity value for the given time shift in dependence on the given time shift and where the apparatus is configured to choose the length of the signal portions to be linearly dependent on the given time shift, within a tolerance of ±1 sample.

22 Claims, 7 Drawing Sheets

(56) References Cited

U.S. PATENT DOCUMENTS

| | | | | |
|---|---|---|---|---|
| 6,604,070 | B1 * | 8/2003 | Gao | G10L 19/00 704/222 |
| 2008/0147384 | A1 * | 6/2008 | Su | G10L 19/12 704/207 |
| 2010/0198586 | A1 | 8/2010 | Edler et al. | |
| 2013/0117015 | A1 | 5/2013 | Bayer et al. | |
| 2016/0133265 | A1 | 5/2016 | Disch et al. | |

FOREIGN PATENT DOCUMENTS

| | | | |
|---|---|---|---|
| EP | 2830064 | A1 | 1/2015 |
| JP | 2004037506 | A | 2/2004 |
| RU | 2436174 | C2 | 12/2011 |
| WO | 2010003563 | A1 | 1/2010 |
| WO | 2015010949 | A1 | 1/2015 |

OTHER PUBLICATIONS

"AAC-ELD Standard", AAC-ELD Standard: http://www.iso.org/iso/iso_catalogue/catalogue_tc/catalogue_detail.htm?csnumber=46457 ISO/IEC 14496-3:200X(E), Contents for Subpart 4, 2009.

Chen, Juin-Hwey "Toll-Quality 16 kb/s CELP Speech Coding with Very Low Complexity", 1995 International Conference on Acoustics, Speech, and Signal Processing; May 9-12, 1995; Detroit, MI, IEEE, NY, NY, (May 9, 1995), vol. 1, doi:10.1109/ICASSP.1995.479261, ISBN 978-0/7803-2431-2, pp. 9-12, XP010625157 [A] 1-20 *1st & 2nd para of section 2.3*, May 1995.

Medan, Yoav et al., "Super Resolution Pitch Determination of Speech Signals", IEEE Service Center, New York, NY, US, (Jan. 1, 1991), vol. 39, No. 1, doi:10.1109/78.80763, ISSN 1053-587X, pp. 40-48, XP000205149 [X] 1-6,8-11,18-20 * equation (2.4) in section II; section II.A.; first paragraph of section V. * [A] 7 [I] 12-17, Jan. 1991.

Moriya, Takehiro et al., "An enhanced encoder for the MPEG-4 ALS Lossless Coding standard", AES Convention 121; Oct. 2006, AES, 60 East 42nd Street, Room 2520 New York 10165-2520, USA, (Oct. 1, 2006), XP040507792 [A] 1-20 * section 3.1 *, Oct. 2006.

Qian, Xiaoshu et al., "A Variable Frame Pitch Estimator and Test Results", 2013 IEEE International Conference on Acoustics, Speech and Signal Processing (ICASSP); Vancoucer, BC; May 26-31, 2013, Piscataway, NJ, (Jan. 1, 1996), vol. 1, doi:10.1109/ICASSP.1996.540332, ISSN 1520-6149, p. 228, XP055352062 [A] 1-20 *Last para, sec 1; sec 2*, May 2013.

"Part 1 of 4—Information technology—Coding of audio-visual objects", AAC-ELD Standard: http://www.iso.org/iso/iso_catalogue/catalogue_tc/catalogue_detail.htm?csnumber=46457 ISO/IEC 14496-3:200X(E), Contents for Subpart 4, 2009.

"Part 2 of 4—Information technology—Coding of audio-visual objects", AAC-ELD Standard: http://www.iso.org/iso/iso_catalogue/catalogue_tc/catalogue_detail.htm?csnumber=46457 ISO/IEC 14496-3:200X(E), Contents for Subpart 4, 2009.

"Part 3 of 4—Information technology—Coding of audio-visual objects", AAC-ELD Standard: http://www.iso.org/iso/iso_catalogue/catalogue_tc/catalogue_detail.htm?csnumber=46457 ISO/IEC 14496-3:200X(E), Contents for Subpart 4, 2009.

"Part 4 of 4—Information technology—Coding of audio-visual objects", AAC-ELD Standard: http://www.iso.org/iso/iso_catalogue/catalogue_tc/catalogue_detail.htm?csnumber=46457 ISO/IEC 14496-3:200X(E), Contents for Subpart 4, 2009.

"Part 1 of 2—Universal Mobile Telecommunitations System (UMTS); LTE; Codec for enhanced Voice Services (EVS); Detailed algorithmic description", 3GPP, TS 26.445, Version 12.3.0, Release 12, Jun. 2015.

"Part 2 of 2—Universal Mobile Telecommunitations System (UMTS); LTE; Codec for enhanced Voice Services (EVS); Detailed algorithmic description", 3GPP, TS 26.445, Version 12.3.0, Release 12, Jun. 2015.

"Source-Controlled Variable-Rate Multimode Wideband Speech Codec (VMR-WB), Service Options 62 and 63 for Spread Spectrum Systems", 3GPP2, C.S0052-A, Version 1.0, Apr. 2005, Apr. 2005.

"Speech codec speech processing functions; Adaptive Multi-Rate—Wideband (AMR-WB) speech codec; Transcoding functions", 3GPP, TS 26.190, Release 12, 2014.

* cited by examiner

APPARATUS AND METHOD FOR DETERMINING A PITCH INFORMATION

CROSS-REFERENCE TO RELATED APPLICATIONS

This application is a continuation of International Application No. PCT/EP2017/074984, filed Oct. 2, 2017, which is incorporated herein by reference in its entirety, and additionally claims priority from European Application No. 16192253.9, filed Oct. 4, 2016, which is also incorporated herein by reference in its entirety.

BACKGROUND OF THE INVENTION

The present invention relates to audio signal processing, more specifically it relates to obtaining a pitch information from an audio signal.

In some algorithms pitch determination is performed based on an autocorrelation of an audio signal. However, these algorithms employ a static amount of signal samples for large ranges of pitch lags.

Consequently, a problem of known solutions is that inaccurate pitch information is obtained due to insufficiently flexible consideration of signal samples of the audio signal for determination of the pitch information.

Therefore, a desire exists for a concept which provides for a better compromise between computational complexity and accuracy of a pitch value determination.

SUMMARY

An embodiment may have an apparatus for determining a pitch information on the basis of an audio signal, wherein the apparatus is configured to obtain a similarity value (R(d); R'(d)) being associated with a given pair of portions of the audio signal having a given time shift (d); wherein the apparatus is configured to choose a length (Len(d)) of signal portions of the audio signal used to obtain the similarity value (R(d); R'(d)) for the given time shift (d) in dependence on the given time shift (d); where the apparatus is configured to choose the length (Len(d)) of the signal portions to be linearly dependent on the given time shift (d), within a tolerance of ±1 sample; wherein the apparatus is configured to choose the length of the signal portions based on $$Len(d)=m\cdot d+\text{startlen}-Pit\text{min}\cdot m,$$

where d is the given time shift, startlen a predetermined minimum length for the signal portions, Pitmin a predetermined smallest considered pitch lag value and m a factor by which the given time shift is scaled, and wherein the apparatus is configured to choose the length of the signal portions as an integer value close to Len(d).

According to another embodiment, a method for determining a pitch information on the basis of an audio signal may have the steps of: obtaining a similarity value (R(d); R'(d)) being associated with a given pair of portions of the audio signal having a given time shift (d); choosing a length (Len(d)) of signal portions of the audio signal used to obtain the similarity value (R(d); R'(d)) for the given time shift (d) in dependence on the given time shift (d); and wherein the length (Len(d)) of the signal portions is chosen to be linearly dependent on the given time shift (d), within a tolerance of ±1 sample; wherein the method has choosing the length of the signal portions based on $$Len(d)=m\cdot d+\text{startlen}-Pit\text{min}\cdot m,$$

where d is the given time shift, startlen a predetermined minimum length for the signal portions, Pitmin a predetermined smallest considered pitch lag value and m a factor by which the given time shift is scaled, and wherein the method has choosing the length of the signal portions as an integer value close to Len(d).

Another embodiment may have a non-transitory digital storage medium having stored thereon a computer program for performing the above inventive method for determining, when said computer program is run by a computer.

Still another embodiment may have an apparatus for determining a pitch information on the basis of an audio signal, wherein the apparatus is configured to obtain a similarity value (R(d); R'(d)) being associated with a given pair of portions of the audio signal having a given time shift (d); wherein the apparatus is configured to choose a length (Len(d)) of signal portions of the audio signal used to obtain the similarity value (R(d); R'(d)) for the given time shift (d) in dependence on the given time shift (d); where the apparatus is configured to choose the length (Len(d)) of the signal portions to be linearly dependent on the given time shift (d), within a tolerance of ±1 sample; wherein the apparatus is configured to determine an information about a characteristic of an identified maximum of a sequence of similarity values (R(d); R'(d)) obtained for different time shifts (d); and wherein the apparatus is configured to provide a pitch frequency on the basis of the identified maximum if the information about the characteristic of the identified maximum indicates that the identified maximum is a local maximum; and wherein the apparatus is configured to proceed to consider one or more other similarity values for estimating the pitch frequency if the information about the characteristic of the maximum does not indicate that the maximum is a local maximum.

According to another embodiment, a method for determining a pitch information on the basis of an audio signal may have the steps of: obtaining a similarity value (R(d); R'(d)) being associated with a given pair of portions of the audio signal having a given time shift (d); choosing a length (Len(d)) of signal portions of the audio signal used to obtain the similarity value (R(d); R'(d)) for the given time shift (d) in dependence on the given time shift (d); and wherein the length (Len(d)) of the signal portions is chosen to be linearly dependent on the given time shift (d), within a tolerance of ±1 sample; wherein the method has determining an information about a characteristic of an identified maximum of a sequence of similarity values (R(d); R'(d)) obtained for different time shifts (d); and wherein the method has providing a pitch frequency on the basis of the identified maximum if the information about the characteristic of the identified maximum indicates that the identified maximum is a local maximum; and wherein the method has proceeding to consider one or more other similarity values for estimating the pitch frequency if the information about the characteristic of the maximum does not indicate that the maximum is a local maximum.

Another embodiment may have a non-transitory digital storage medium having stored thereon a computer program for performing the above inventive method for determining, when said computer program is run by a computer.

An embodiment according to the invention creates an apparatus for determining a pitch information on the basis of an audio signal. The apparatus is configured to obtain a similarity value being associated with a given pair of portions of the audio signal having a given time shift. Furthermore, the apparatus is configured to choose a length of signal portions of the audio signal used to obtain a similarity value for the given time shift in dependence on the given time shift. Additionally, the apparatus is configured to choose the length of the signal portions to be linearly dependent on the given time shift, within a tolerance of ±1 samples.

The described apparatus enables an accurate determination of a pitch information while avoiding an evaluation of unnecessarily large portions of the audio signal. Reasonably accurate pitch determination is achieved by using sufficient length of signal portions and low computational complexity is achieved by using a reasonable small length of the considered signal portions. Therefore, linear dependency of the signal portion length on the given time shift provides a good tradeoff, as it avoids excessive length of the signal portions while still providing long enough signal portions to obtain an accurate pitch information. As a pitch information is an information about frequency, a periodicity is associated with it. The length of the pitch period corresponding to a pitch is characterized by a time shift which results in a high similarity value. Therefore, it is beneficial to employ signal portions of a length which is linearly dependent on the given time shift. In other words, for example for checking whether a signal has a low pitch which corresponds to a long pitch period, a large time shift is used. In this case, when employing a linear dependency with a positive slope, an appropriately larger signal portion length is chosen for determination of the pitch information compared to when checking a higher pitch corresponding to a comparatively shorter pitch period. Thus, the concept allows to adjust the length of the portions such that a reasonable portion of a signal under consideration is used both when evaluating a smaller time shift and when evaluating a larger time shift.

According to an embodiment of the invention the apparatus is configured to obtain a pitch information based on a sequence of similarity values. Considering more than one similarity value improves the accuracy of the determined pitch.

According to an embodiment of the invention, the apparatus is configured to obtain the sequence of similarity values based on similarity values for time shifts in a range starting between 1 ms and 4 ms and extending up to time shifts between 15 ms to 25 ms. The described embodiment is beneficial, as the considered range of time shifts is a characteristic range for human speech, corresponding to the fundamental frequencies of speech. Additionally, restricting the range of time shifts to the described values reduces computational complexity in determining the sequences of similarity values, as it limits the amount of similarity values which need to be determined.

According to a further embodiment of the invention, the apparatus is configured to step-wisely increase the length of the signal portions in steps of one sample with increasing time shift, when obtaining similarity values for different pairs of portions having different time shifts. The described embodiment is especially useful due to its ability of providing signal portions with a minimum length difference. In other words, a fine granularity of lengths is achieved, enabling a flexible choice of signal portion lengths, thereby allowing for a good tradeoff between accuracy and computational complexity.

According to an embodiment of the invention, the apparatus is configured to increase the length of the signal portions in integer precision with increasing time shift, when obtaining similarity values for different pairs of portions having different time shifts. Increasing the length of the signal portions with integer precision is especially beneficial due to the low computational complexity involved in it. In other words, for example no upsampling or fractional delays need to be considered.

According to an embodiment of the invention, the apparatus is configured to increase the length of the signal portions, between a predetermined minimum length and a predetermined maximum length, linearly in dependence on the time shift. The predetermined minimum length is used for a shortest time shift corresponding to a maximum pitch frequency, and the predetermined maximum length is used for a longest time shift corresponding to a minimum pitch frequency. The described embodiment helps in keeping computational complexity within a prescribed range determined by the predetermined minimum length and the predetermined maximum length. Moreover, the predetermined minimum length and the predetermined maximum length can be chosen in accordance for example with the human vocal tract, as to capture for example a whole cycle of a considered pitch period.

According to an embodiment of the invention, the apparatus is configured to choose the length of the signal portions based on $$Len(d)=m\cdot d+\text{startlen}-Pit\text{min}\cdot m,$$

where d is the given time shift, startlen a predetermined minimum length for the signal portions, Pitmin a predetermined smallest considered pitch lag value, representing a minimum value for d, and m a factor by which the given time shift is scaled, where for example $m\leq 1$. Furthermore, the apparatus is configured to choose the length of the signal portions as an integer value close to Len(d). The choice of an integer value close to Len(d) can be based on a round function, a floor function, a ceil function or a truncate function. The round function rounds the value of Len(d) to the nearest integer value, the floor function rounds the value of Len(d) to the nearest integer towards minus infinity, the ceil function rounds the value of Len(d) towards the next integer in the direction of plus infinity and the truncate function removes any decimal values of Len(d) thereby returning an integer value.

According to an embodiment of the invention, the apparatus is configured to compute an autocorrelation value on the basis of two time shifted signal portions of the audio signal, time shifted by the given time shift, in order to obtain the similarity value wherein a similarity value can be an autocorrelation value, or a value derived from an autocorrelation value. Moreover, the number of sample values of the audio signal considered in the computation of the autocorrelation value is determined by the chosen length. Using an autocorrelation for pitch estimation is especially beneficial due to a low computational complexity involved in computing an autocorrelation. Varying the number of sample values used for calculating the autocorrelation value as described, enables estimation of more accurate pitch frequencies while avoiding an unnecessarily long autocorrelation summation length for small time shifts.

According to an embodiment of the invention, the apparatus is configured to obtain the similarity values based on $$R'(d)=\Sigma_{n=0}^{Len(d)}s(n)s(n-d),$$

where s(n) is a sample of the audio signal at time n, Len(d) is an information about the length of the signal portions for the given time shift d and d is the given time shift. The upper limit of the summation can for example also be Len(d)−1 and the value d of the time shift can be in the interval [Pitmin, Pitmax].

Calculating the similarity values in the described way offers a fast and flexible way of obtaining autocorrelation values. Especially, the upper limit of the summation (Len(d) or Len(d)−1) which is in dependence on the considered time shift (d), may provide a sufficiently long signal portion for comprising a whole period of the pitch frequency to be determined.

According to an embodiment of the invention, the apparatus is configured to obtain a location information of a maximum value of a plurality of similarity values. Furthermore, the apparatus is configured to obtain a pitch information based on the location information corresponding to a considered time shift of the maximum value. The described embodiment is especially helpful in reducing computational complexity, as a search for a maximum value can be performed with low computational complexity. This can for example be formulated as $$R(T_0) = \max_d R(d), \text{ or } R'(T_0) = \max_d R'(d),$$

where d ϵ [Pitmin; Pitmax] and $T_0$ denotes the location of a found maximum.

According to an embodiment of the invention, the apparatus is configured to apply a normalization to the similarity value using at least two normalization values. The two normalization values comprise a first normalization value representing a statistical characteristic, for example an energy value, of a first portion of the given pair of portions and a second normalization value representing a statistical characteristic, for example an energy value, of a second portion of the given pair of portions. The normalization is applied to the similarity value in order to derive a normalized similarity value. The described normalization is helpful for compensating energy fluctuations in the audio signal, for example energy fluctuations in a speech signal. Thereby, similarity values which are comparable over wide range of time shifts are provided, making a more accurate result of the pitch determination feasible.

According to an embodiment of the invention, the apparatus is configured to obtain a normalized similarity value R(d) based on $$R(d) = \frac{R'(d)w(d)}{\sqrt{norm(0)norm(d)}},$$

where R'(d) is a similarity value and w(d) is a windowing function. Normalizing the similarity value in the described way enables a more accurate determination of a pitch information due to less energy fluctuation of the similarity value. Especially, the considered value R'(d) can be subject to energy variations in the signal portions considered for its determination. Employing the described normalization frees the value R(d) form the energy variations in the considered signal portions.

According to an embodiment of the invention, the apparatus is configured to recursively derive a normalization value, e.g. a norm value, for a new time shift d from a normalization value for a previous time shift, e.g. d−1, d−2 and so on, by adding one or more energy values of signal samples included in a new signal portion and not included in an old signal portion and by subtracting one or more energy values of signal samples included in the old signal portion and not included in the new signal portion. The described recursive computation of the normalization value enables a fast and memory saving computation of a normalization value based on a previous normalization value.

According to an embodiment of the invention, the apparatus is configured to obtain a normalization value norm(d) based on $$\text{norm}(d)=\text{norm}(d-1)+x_d^2-x_{d+Len(d)}^2,$$

where $x_d$ is a sample of the audio signal contained in the signal portion according to the time shift d but not contained in the signal portion according to time shift d−1, $x_{d+Len(d)}$ is a sample of the audio signal not contained in the signal portion according to time shift d but contained in the signal portion according to time shift d−1 of the audio signal and norm(d−1) is a normalization value obtained for a previously considered signal portion according to time shift d−1 outside of the new signal portion of time shift d. The described way of obtaining a normalization value enables a fast and simple way of computing a normalization value based on a previous normalization value. Moreover, estimating the normalization value in the described way is especially suitable for embodiments of the invention employed in portable devices with low power consumption, as the computation exhibits low complexity and low memory demand.

According to a further embodiment of the invention, the apparatus is configured to determine an information, for example an index or a local maximum information which is a result of a local maximum check, about a characteristic of an identified maximum of a sequence of similarity values obtained for different time shifts. Moreover, the apparatus is configured to provide a pitch frequency on the basis of the identified maximum if the information about the characteristic of the identified maximum indicates that the identified maximum is a local maximum. Furthermore, the apparatus is configured to proceed to consider one or more other similarity values which are different from the previously identified maximum value for estimating the pitch frequency if the information about the characteristic of the maximum does not indicate that the maximum is a local maximum, for example if it indicates that the location is at an edge of a search interval. An inaccurate pitch information can be due to the fact that it is based on an identified maximum which is not a local maximum. Therefore, a check of the identified maximum and the resulting treatment of the identified maximum in the described way is useful for avoiding inaccurate pitch information determination.

According to an embodiment of the invention, the apparatus is configured to determine if an identified maximum is located at the border of the sequence of similarity values as the information about a characteristic of the identified maximum. If a maximum is located at the border of the sequence of similarity values, values beyond this border can be even higher than the identified maximum and therefore the identified maximum may not represent a true local maximum. In other words, it is good to know if an identified maximum is at the border in order to react adequately. A reaction for example could be choosing a true local maximum inside the sequence of similarity values, as the previously identified maximum location may not represent a valid pitch lag value.

According to an embodiment of the invention, the apparatus is configured to selectively consider one or more other similarity values beyond the border of the sequence of similarity values, for example beyond an initial search interval, if the information about a characteristic of the identified maximum indicates that the identified maximum is located at the border of the sequence of similarity values.

Having the opportunity to consider one or more other similarity values beyond the border of the sequence of similarity values helps in ensuring that an accurate and valid pitch information is obtained.

According to an embodiment of the invention, the apparatus is configured to determine a pitch information in an open-loop search or in a closed-loop search. The described embodiment is useful for use in audio signal encoders which are configured to have a two-stage pitch information determination, for example an open-loop search and a closed-loop search.

An embodiment of the invention provides for a method for determining a pitch information on the basis of an audio signal. The method comprises: obtaining a similarity value being associated with a given pair of portions of the audio signal having a given time shift. Furthermore, the method comprises choosing a length of signal portions of the audio signal, of the pair of portions, used to obtain the similarity value for the given time shift in dependence on the given time shift and wherein the length of the signal portions is chosen to be linearly dependent on the given time shift, within a tolerance of ±1 sample. The described method provides reliable support for obtaining similarity value based on the information of the associated signal portions corresponding to the considered time shift.

A further embodiment of the invention is a computer program with a program code for performing the method when the computer program runs on a computer or a microcontroller.

The described program is especially suitable for employment in mobile devices, for example mobile phones.

Further embodiments according to the invention describe a robust pitch search with adaptive correlation size.

BRIEF DESCRIPTION OF THE DRAWINGS

Embodiments of the present invention will be explained below with reference to the accompanying drawings, in which.

DETAILED DESCRIPTION OF THE INVENTION

Figure 1:
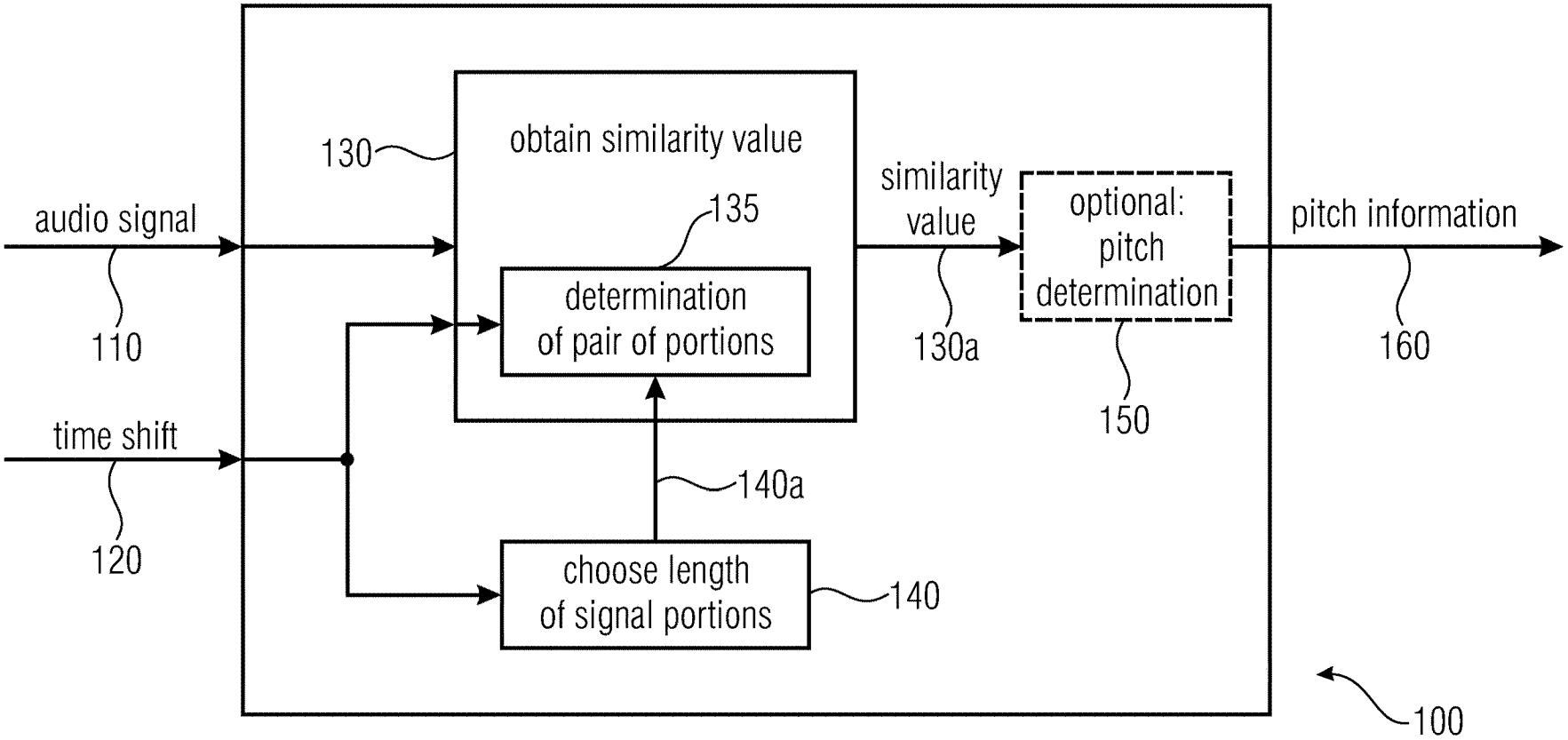
FIG. 1 shows a flow chart of an apparatus according to an embodiment of the invention.

FIG. 1 depicts a flow chart of an apparatus 100 according to an embodiment of the invention for determination of a pitch information 160. The apparatus 100 uses as inputs an audio signal 110, for example a speech signal, and a time shift value 120. Based on the time shift 120, the apparatus 100 chooses a length of a signal portion (for example, using a block 140) and provides an information 140*a* describing a length of the signal portions for determination 135 of a pair of portions used to obtain 130 a similarity value 130*a* (for example in block or similarity value obtainer 130). Based on the similarity value 130*a* the pitch information 160 can be determined in an optional pitch determination (e.g. in block or pitch determinator 150). The length 140*a* of the signal portion is determined to be linearly dependent on the time shift 120. The provided length 140*a* of signal portions is used to determine 135 a pair of portions of the audio signal 110, wherein the length 140*a* of this pair of signal portions is flexibly based on the time shift 120. Thus, a similarity value 130*a* obtained based on the pair of portions provides a reliable similarity value 130*a* for determination of a pitch frequency. For example if a long pitch period is considered, corresponding to a large time shift 120, the chosen length 140*a* of signal portions will be correspondingly large, in order to be able to capture a whole cycle of the considered pitch. The described apparatus therefore offers a basis for a reliable, accurate, non-complex and flexible pitch determination. Moreover, it should be noted that the apparatus 100 according to FIG. 1 can be supplemented by any of the features and functionalities described herein, either individually or in combination.

Figure 2:
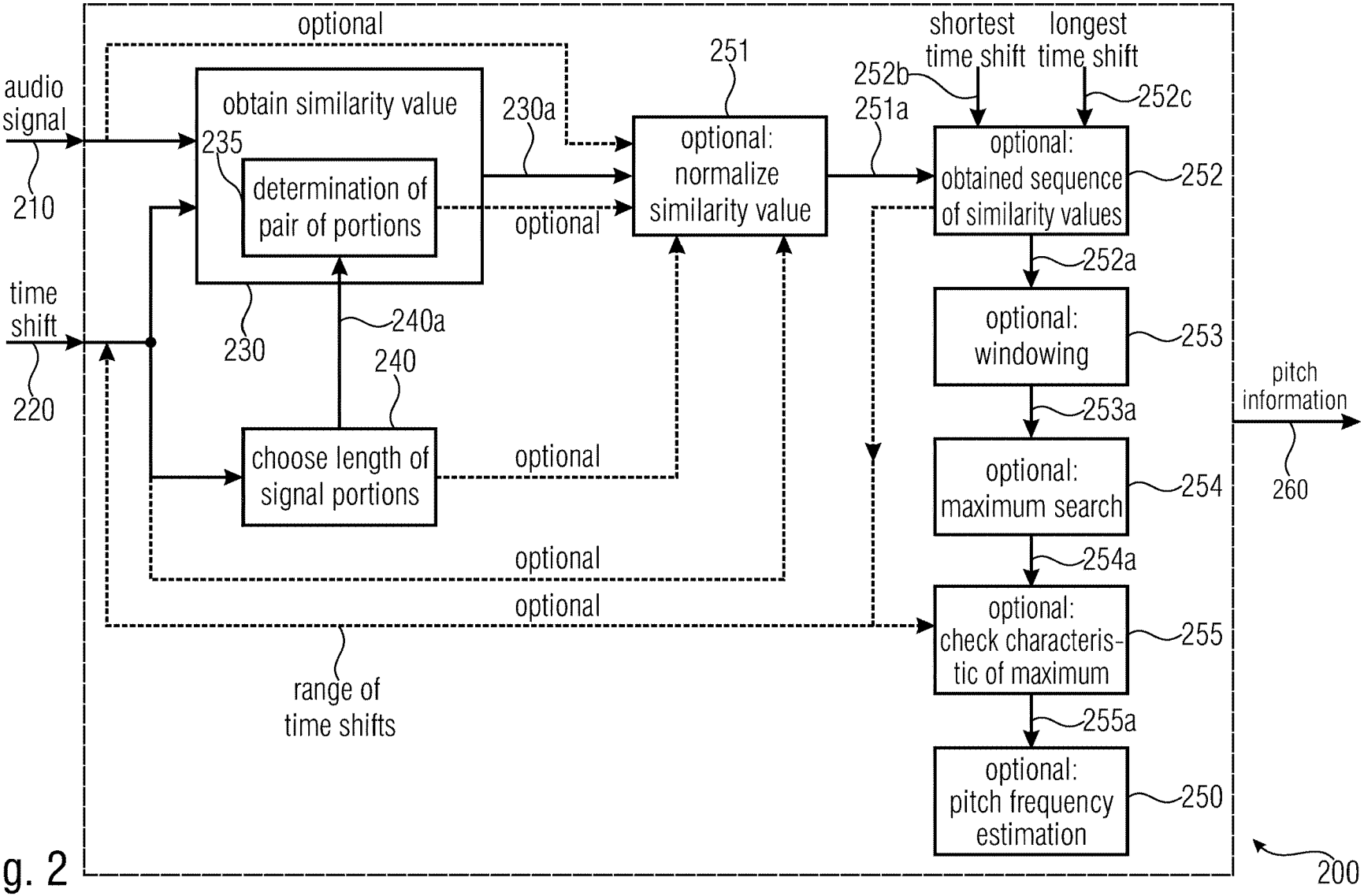
FIG. 2 shows a flow chart of an apparatus according to an embodiment of the invention.

FIG. 2 shows a flow chart of an apparatus 200 according to an embodiment of the invention. The apparatus 200 takes as input an audio signal 210 and a time shift value 220 and delivers as output a pitch information 260. According to the time shift 220, the length 240*a* of signal portions is determined (in block 240). The determined length 240*a* of signal portions is provided for determination 235 of a pair of portions, which in addition is based on the given time shift 220 and the audio signal 210. Based on the determined pair of portions a similarity value 230*a* is obtained (in block 230).

In a further optional step (block 251), the similarity value 230*a* is normalized 251 based on energy values of the determined pair of portions, thereby delivering a normalized similarity value 251*a*. Based on the similarity value 230*a* or the normalized similarity value 251*a* a sequence 252*a* of similarity values can be obtained 252 in an optional step (block 252). The obtained sequence 252*a* of similarity values is obtained for a shortest time shift 252*b* up to a longest time shift 252*c*. Thus, block 252 may, for example provide the time shift information 220 within the given range (from a shortest time shift 252*b* up to a longest time shift 252*c*).

In a further optional step (block 253), the sequence 252*a* of similarity values is subject to windowing 253. Thereby, a windowed sequence 253*a* of similarity values is obtained, wherein the windowing 253 can improve accuracy of the to be determined pitch information 260 by emphasizing or deemphasizing certain ranges of the sequence 252*a* of similarity values.

Additionally, the sequence 252*a* of similarity values or the windowed sequence 253*a* of similarity values can be used in an optional maximum search 254, to obtain a maximum location information 254*a*.

Based on a maximum location information 254*a*, in a further optional step a check of a characteristic of the maximum location information 254*a* is performed (in block 255). The check of the characteristic of the identified maximum location 255 is based on the information 254*a* of the maximum location, the shortest time shift considered 252*b* and the longest time shift considered 252*c*. If the characteristic of the maximum indicates that the maximum is coinciding with the shortest time shift 252*b* or the longest time shift 252*c*, a decision is made, that a new maximum value is to be considered. The maximum value to be considered can be found in a range from the shortest time shift 252*b* to the longest time shift 252*c*, or beyond the shortest time shift 252*b* or the longest time shift 252*c*. If the new maximum will be chosen from between the shortest time shift 252*b* and the longest shift 252*c* a new local maximum in between the two values will be chosen and provided as the new local maximum 255*a*. Alternatively, a new maximum value can be searched beyond the shortest time shift 252*b* or the longest time shift 252*c*, and if a new maximum value is found the corresponding location or an information 255*a* to a corresponding location will be provided. In a final optional step, a pitch frequency estimation is performed (in block 250).

The audio signal 210 can be provided in a decimated version, thereby reducing computation complexity. This is due to the fact that a decimated signal typically displays a reduced sampling rate and therefore exhibits less samples per second. This in turn leads to a lower complexity of the calculation, as for an equivalent time range less sample values need to be considered than for an upsampled signal or equivalently for a signal with a higher sampling rate. Therefore, in a first stage (not shown) the audio signal 210 can be decimated to a sampling frequency for example varying between 5.3 and 8 kHz, depending on the input sampling rate.

Figure 3:
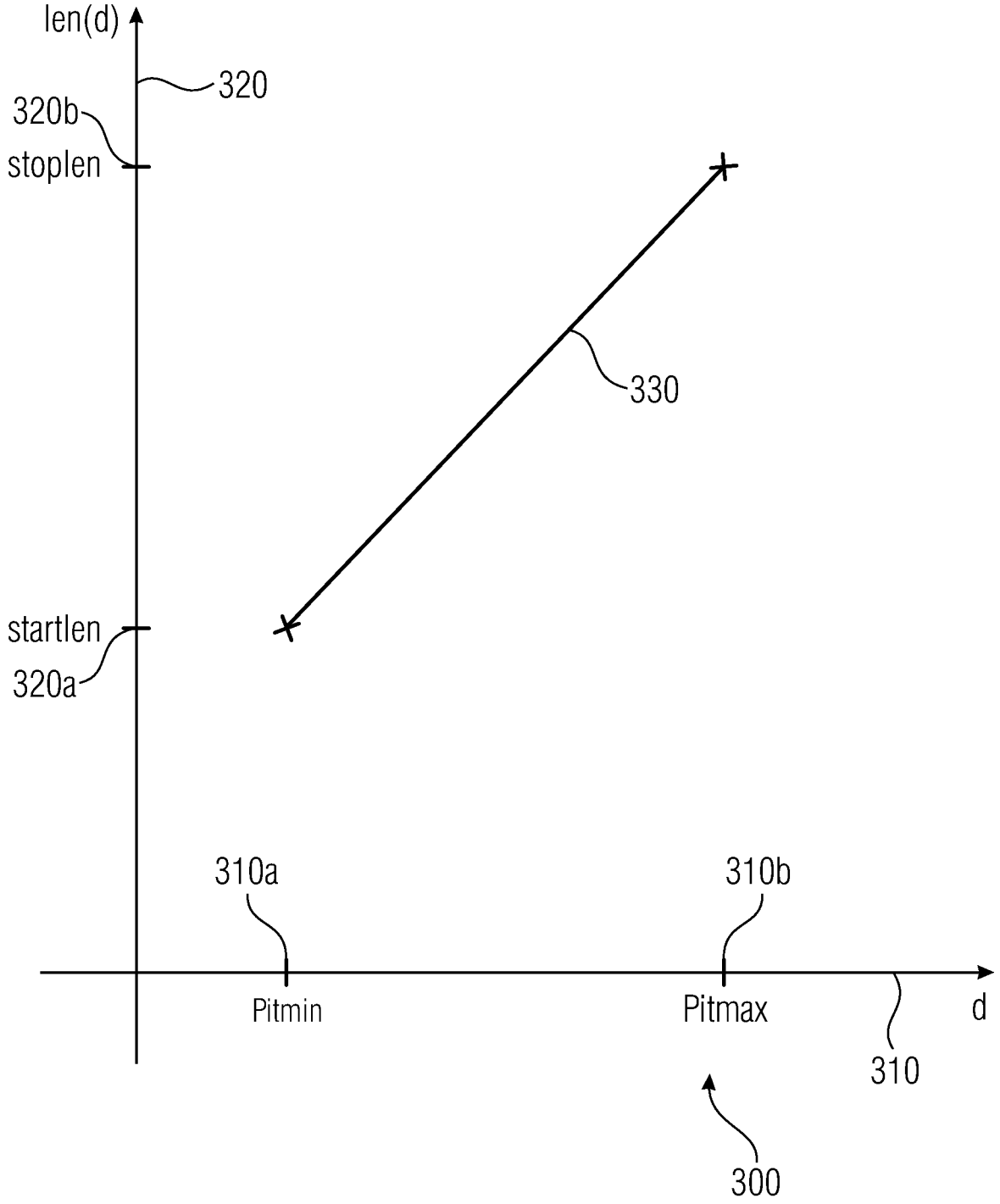
FIG. 3 shows a graph according to an embodiment of the invention.

In the following, it will be described how the length information 240*a* of the signal portions can be determined by block 240. FIG. 3 shows a graph 300 according to an aspect of the invention. On the horizontal axis 310, the value of the time shift d is shown. A shortest time shift 310*a* and a longest time shift 310*b* is indicated on the horizontal axis, labeled Pitmin and Pitmax, respectively, which may correspond to the shortest time shift 252*b* and longest time shift 252*b* in FIG. 2. On the vertical axis 320 the length of the considered signal portions is shown, wherein this length may be represented by the length information 140*a* or 240*a*. A minimum length 320*a* and a maximum length 320*b* are indicated on the vertical axis, labeled startlen and stoplen, respectively. The line 330 illustrates a linear increase of the length of the signal portions with increasing time shift. Furthermore, the shortest time shift 310*a* is labeled as Pitmin corresponding to the minimum pitch value considered and the longest time shift 310*b* is labeled as Pitmax corresponding to the maximum pitch value considered. The graph 300 illustrates the choice of the length of the signal portions used for obtaining the similarity value, enabling a computational efficient and reliable pitch determination.

Figure 4:
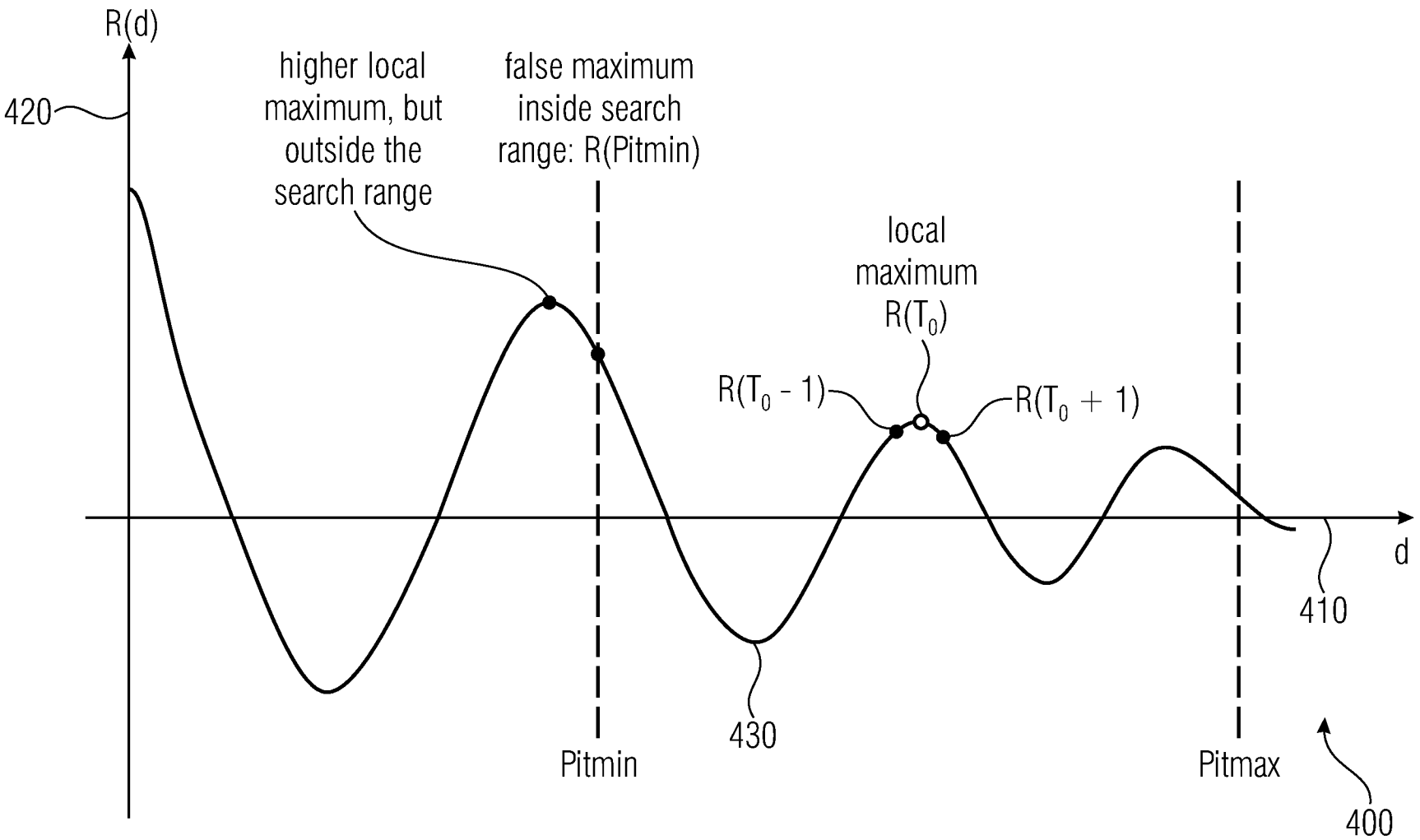
FIG. 4 shows a graph according to an embodiment of the invention.

Taking reference to FIG. 4, the search of a maximum location information 254*a* or 255*a* is illustrated as performed for example in block 254 or 255. FIG. 4 shows a graph 400 according to an aspect of the invention. On the horizontal axis 410 the time shift d is shown, which may be the time shift 120 or 220. On the vertical axis 420 values of the similarity value, for example autocorrelation values, are shown, which may be the similarity value 130*a*, 230*a* or 251*a* obtained in block 130 or 230. A curve 430 shows an example evolution of the similarity values, for example the sequence 252*a* of similarity values, in dependence on the time shift d. The curve 430 has a local maximum $R(T_0)$ in between the vertically dashed lines labeled Pitmin and Pitmax. The value to the left of the local maximum $R(T_0-1)$ is smaller than $R(T_0)$ and the value to the right of $R(T_0)$, $R(T_0+1)$, is smaller than $R(T_0)$, thereby, $R(T_0)$ may be characterized as a true local maximum. Furthermore, the vertically dashed lines labeled Pitmin and Pitmax illustrate the range in which a maximum search can be performed (for example in block 254) and for which values d of the time shift similarity values are obtained to form the sequence 252*a*. The maximum search can for example be the maximum search as indicated in block 254 in apparatus 200. Moreover, a maximum is identified which corresponds with the vertically dashed line labeled Pitmin. However, this identified maximum is not a true local maximum, as a higher local maximum is available outside the search range. Therefore, the maximum coinciding with Pitmin, R(Pitmin), is a false maximum. Taking reference to FIG. 2, the described curve 430 may display the sequence 252*a* on which a search is performed in block 254. The search 254 may identify the value R(Pitmin) as the maximum and, therefore, return Pitmin as the maximum location information 254*a*. The obtained maximum location information 254*a* may be used in the check 255 of the characteristic of the maximum. The check 255 may identify the maximum location information 254 to indicate that the maximum is located on the border of the search range. In response to this finding, in one implementation, the checking (block 255) may discard the maximum at Pitmin and rather choose a true local maximum inside the search range corresponding to $R(T_0)$. Resulting in a maximum location information 255*a* being characterized by $T_0$ instead of Pitmin.

Figure 5:
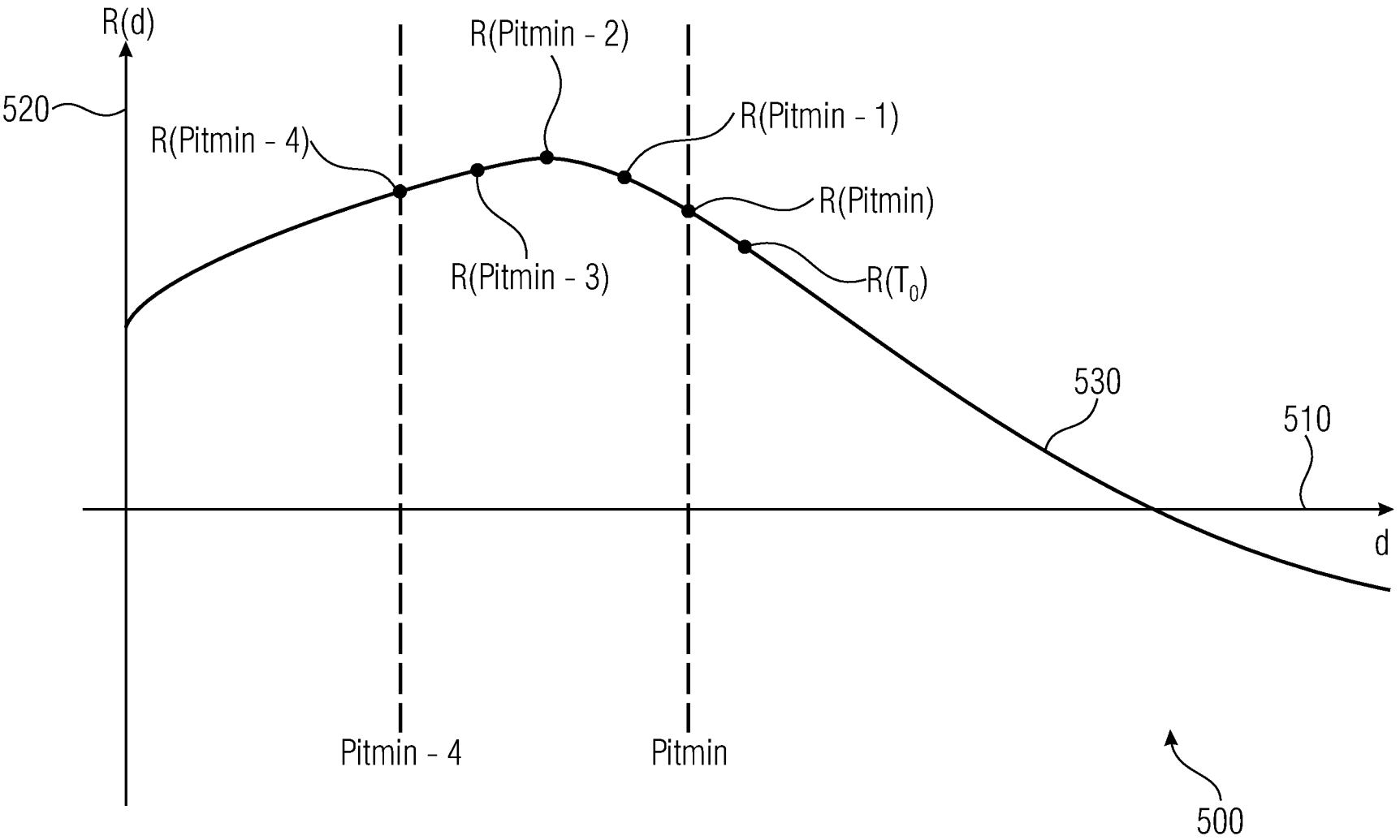
FIG. 5 shows a graph according to an embodiment of the invention.

In the following, an alternative implementation of the check (block 255) will be described taking reference to FIG. 5. FIG. 5 shows a graph 500 according to an aspect of the invention. On the horizontal axis 510 the time shift value is shown. Furthermore, on the vertical axis 520 the similarity value is shown in dependence on the time shift. Moreover, a curve 530 is plotted in the graph 500 which for example illustrates similarity values, e.g. 130*a*, 230*a* or 251*a*. The curve 530 is similar to curve 430 in FIG. 4 and shows an alternative procedure if the check 255 finds out that a maximum location information 254*a* indicates that a maximum is located at the border of the search range. The graph 500 shows a maximum value of the curve 530 on the intersection with the vertically dashed line labeled Pitmin with respect to values to the right of it, as illustrated already in graph 400 of FIG. 4 (R(Pitmin) is a maximum between d=Pitmin and d=Pitmax). Alternatively, to the procedure described in FIG. 4, the search range is extended beyond Pitmin to check 255 if the found maximum R(Pitmin) is truly a local maximum (with smaller values on both sides). While searching beyond Pitmin a new local maximum R(Pitmin−2) is found which in turn will be returned as a (new, revised) maximum location information 255*a*. The additional similarity values beyond the similarity value R(Pitmin) can for example be available due to the fact that this additional search is performed on an upsampled version of the curve 430 of FIG. 4. Therefore, no new calculations may be necessary for retrieval of the values beyond R(Pitmin) except for an upsampling of the previously employed sequence of similarity values.

Figure 6:
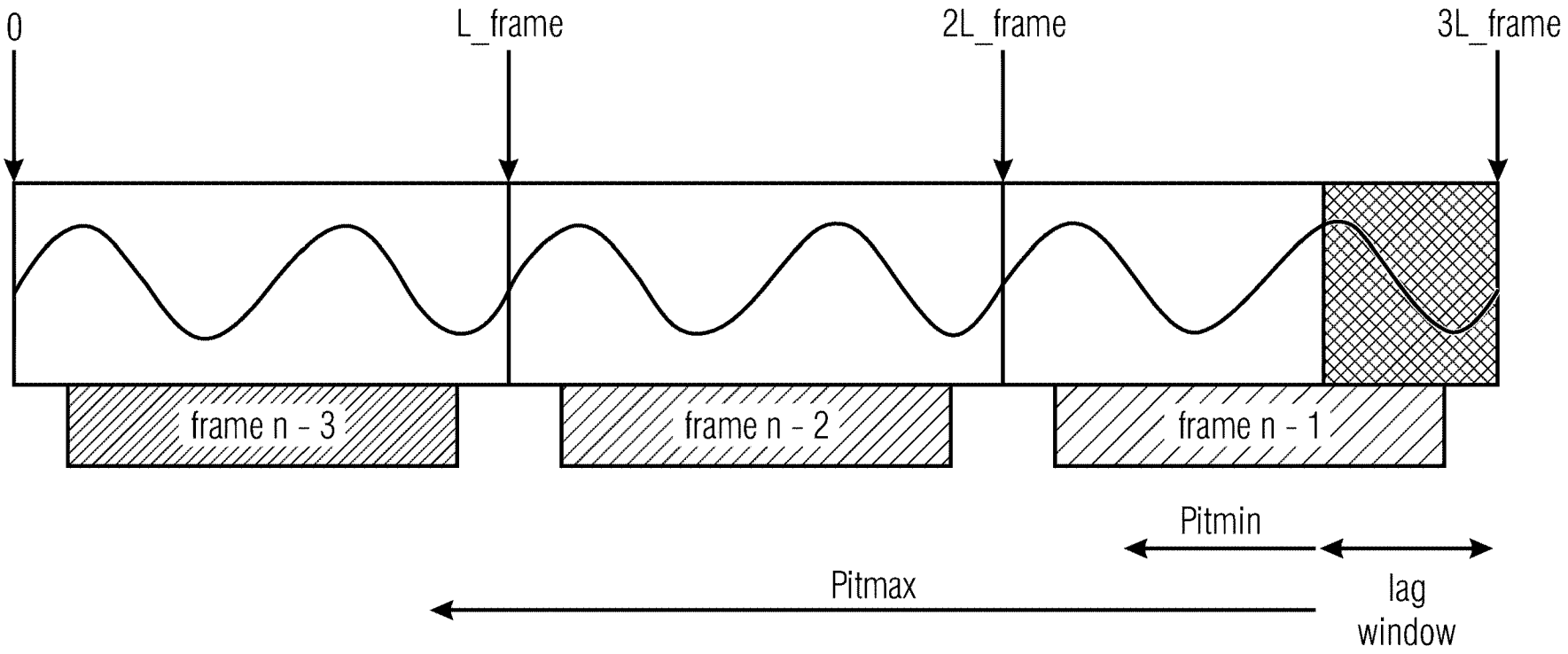
FIG. 6 shows a schematic of a signal.

FIG. 6 shows an illustrative graph of an audio signal, for example of the audio signal 110 and 210. The signal has a frame-wise sectioning and three frames are displayed. Two arrows indicate the shortest time shift Pitmin and the longest time shift Pitmax, and the arrow labeled lag window indicates the variability of the lag window to scale in between the values Pitmin and Pitmax.

Figure 7:
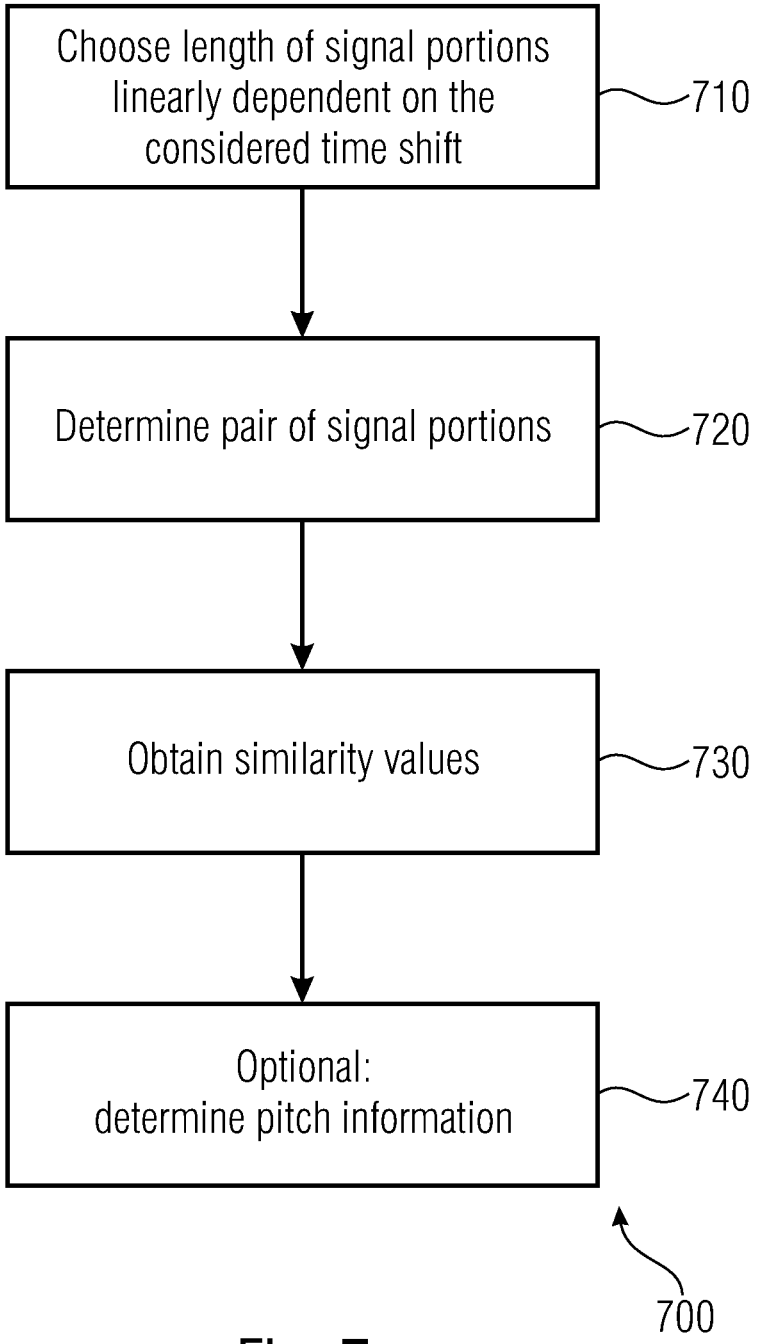
FIG. 7 shows a flow chart of a method according to an embodiment of the invention.

FIG. 7 illustrates a flow chart 700 of a method according to an aspect of the invention. In a first step, the length of signal portions is determined 710, wherein the length is linearly dependent on the considered time shift. Subsequently, based on the determined length, pair of signal portions are determined 720. Furthermore, based on the determined pair of signal portions, similarity values are obtained 730. Optionally, in a final step based on the determined similarity value a pitch information is determined 740.

The method 700 can be supplemented by any of the featured and functionalities described herein, also with respect to the apparatus.

Further Aspects and Conclusion

In the following, some aspects and thoughts according to the present invention are treated.

An aspect according to the invention is finding the fundamental frequency, i.e. the pitch value (also called lag value in time domain), on a speech signal using the autocorrelation method. In the speech coder AMR-WB codec [1], the pitch search is split into an open-loop and closed-loop pitch search. The open-loop pitch search is a process of estimating the near optimal lag directly from the weighted speech input. Depending on the mode, the open-loop pitch analysis is performed once per frame (every 20 ms) or twice per frame (each 10 ms) to find two estimates of the pitch lag in each frame. This is done in order to simplify the pitch analysis and confine the closed-loop pitch search to a small number of lags around the open-loop estimated lags. In some embodiments, such a procedure may optionally be used.

The search range is adjusted to the human vocal tract. Therefore, the pitch search algorithm, for example of AMR-WB, is constrained to search only between the minimum pitch value of 55 Hz and the maximum pitch value of 380 Hz. The AMR-WB codec [1] is using a fix search window size for the autocorrelation. It has been found that this fix search window size is not optimal: sometimes the correlation window for pitch lag estimation may fail to contain a complete pitch cycle, thus making correlation difficult or not meaningful; if the window is too large, it may cause complexity problems and also increase the difficulty to detect a short pitch lag. It has also been found that an oversized window will cost a lot of additional complexity. VMR-WB [2] and the EVS codec [3] are using respectively three and up to four different lengths for the autocorrelation window, divided in four sections: [10, 16], [17, 31], [32, 61] and [62, 115], where the pitch range is from 10 to 115. It has been found that a main drawback is that pitch values inside one section are using the same autocorrelation size and therefore are not treated equally, which can lead to wrong pitch values. For example, the pitch values of 62 and 115 are using the same autocorrelation length of 115. In some codecs, pitch values of the last frames are taken into account. However, prior knowledge about the last pitch value is not always available, for example in codecs operating in the frequency domain where no pitch values is needed for normal processing, like AAC-ELD [4].

In the following, various aspects of the present invention are further discussed.

An aspect of the invention presents an approach with a low complexity and robust pitch search using a pitch-adaptive autocorrelation size on integer precision. It does not need any prior knowledge of the signal, like previous pitch values. Such an approach may, for example, be implemented using the selection of the length of signal portions as performed by blocks 140,240. For complexity reasons, the pitch search can be separated into two stages similar to the pitch search in AMR-WB codec [1].

In the AMR-WB codec [1], the search range for the pitch search is adapted on the human vocal tract. Therefore the pitch values of 55 Hz to 376 Hz at the sampling rate of 12.8 kHz are observed. Based on this, the borders of Pitmax=872 samples and Pitmin=126 samples for a sampling rate of 48 kHz will be used in an approach according to an aspect of the invention. This corresponds to the pitch values from 55 Hz to 380 Hz.

According to a further aspect of the invention, in a first stage, the signal, e.g. signal 110 or 210, is downsampled like in the AMR-WB codec [1], for example in a not-shown stage of apparatuses 100 and 200. But instead of decimation the signal to a fix sampling frequency of 6.4 kHz, the signal (e.g. signal 110 or 210) is decimated to a sampling frequency varying between 5.3 and 8 kHz depending of the input sampling rate. The decimation factor decim is chosen such as:

$$decim = \begin{cases} 2, & fs \le 16 \text{ kHz} \\ 3, & fs \le 24 \text{ kHz} \\ 4, & fs \le 32 \text{ kHz} \\ 6, & fs > 32 \text{ kHz} \end{cases}$$

where fs is the input sampling rate. A downsampling is done via an FIR filter with the taps being

[0.0101, 0.2203, 0.5391, 0.2203, 0.0101] for decim=2,

[0.0068, 0.0664, 0.2465, 0.3608, 0.2465, 0.0664, 0.0068] for decim=3,

[0.0051, 0.0294, 0.1107, 0.2193, 0.2710, 0.2193, 0.1107, 0.0294, 0.0051] for decim=4 and

[0.0034, 0.0106, 0.0333, 0.0739, 0.1236, 0.1648, 0.1809, 0.1648, 0.1236, 0.0739, 0.0333, 0.0106, 0.0034] for decim=6 (for example, in order to avoid aliasing).

According to an aspect of the invention, a pitch search can be done on the downsampled version (for example, on signal 110, 210) via the autocorrelation method on an iterative loop (for example, controlled by block 252) from the minimum lag $$pit\min = \frac{Pit\min}{decim}$$

to the maximum lag value $$pit\max = \frac{Pit\max}{decim}$$

with me autocorrelation size (represented, for example, by the length information 240*a*) going from 5 ms to 10 ms on integer precision.

In some algorithms, there is a possibility that the maximum of the autocorrelation function corresponds to a multiple or sub-multiple of the pitch-lag d and that the estimated pitch-lag will therefore not be correct. EP0628947 [5] addresses this problem by applying a weighting function w(d) to the autocorrelation function R:

$$R(d)=R(d)\cdot w(d),\ d=pit\min \ldots pit\max$$

where the weighting function has the following form: $w(d)=i^{\log_2 K}$. K is a tuning parameter which is set at a value low enough to reduce the probability of obtaining a maximum for R(d) at a multiple of the pitch lag but at the same time high enough to exclude sub-multiples of the pitch-lag. Similar to the AMR-WB codec [1], this approach uses the weighting function used with K=0.7. The described weighting may be the windowing as performed in block 253.

In some algorithms, like in the AMR-WB codec [1], the maximum autocorrelation value is finally normalized, this allows to compare this maximum across signals or against a threshold value. However, according to an aspect of the invention, to increase the robustness of the pitch search, by making the autocorrelation free of energy fluctuations in the signal, the autocorrelation values gets normalized, for example in block 251, before the maximization (or maximum search) is done as follows:

$$R(d) = \frac{R'(d) \cdot w(d)}{\sqrt{norm(0) \cdot norm(d)}}$$

where R(d) is the normalized autocorrelation value between the unshifted signal and the left shifted signal by d samples, R'(d) is the autocorrelation value between the unshifted signal and the left shifted signal by d samples, w(d) is the weighting factor of d, norm(0) is the dot product of the unshifted signal part (for example, of the first portion of the pair of portions) and norm(d) is the dot product of the signal part shifted left by d samples (for example, of the second portion of the pair of portions). (For example, R(d) may correspond to the normalized similarity value 251*a*, and R'(d) may correspond to the similarity value 230*a* or 130*a*)

According to a further aspect of the invention, to save complexity, the normalization values norm(0) and norm(d), which may be used for normalization and estimated in block 251, are calculated with an updating mechanism. Thus, norm(d) can be calculated as:

$$\text{norm}(d)=\text{norm}(d-1)+x_d^2-x_{d+len(d)}^2$$

where $x_d$ is the signal sample left shifted by d samples with the search window of length len(d). Only for the initial values of norm(0) and norm(pitmin), the full dot products have to be calculated with len(pitmin). If the length of the search window is changing from d−1 to d, the normalization value needs an additional update of len(d−1)−len(d) values.

According to another aspect of the invention, another major difference to some pitch search algorithms based on the autocorrelation method, is that this approach only choses pitch values, which represents a real local maximum, for example performed in block 255. Thus, false pitch results can be avoided, which happen if a maximum of the autocorrelation is outside the search range (for example, confer to the example described with respect to FIGS. 4 and 5). This means, the lag value of d is only used, if:

$$R(d-1) \leq R(d) \geq R(d+1).$$

Like done in the AMR-WB codec [1], a second stage of the pitch search (e.g. closed loop) is operating in the original sampled signal domain and only uses a small number of lags around the upsampled open-loop estimated lag $T_0$. The pitch search, for example the maximum search in 254, also uses a search window length Len (which may be a constant search window length in some embodiments), but it is now dependent of $T_0$ as follows:

$$Len = m \cdot T_0 + startlen - Pit\min \cdot m$$

where $$m = \frac{(stoplen - startlen)}{Pit\max - Pit\min}$$

and startlen=5 ms and stoplen=10 ms.

According to a further aspect of the invention, the search range, for example in the maximum search 254, is limited by where δ=4·decim.

$$\left[\max\left(Pit\min, T_0 - \frac{\delta}{2}\right), \min\left(Pit\max, T_0 + \frac{\delta}{2}\right)\right]$$

According to an aspect of the invention, the algorithm chooses the lag value T belonging to the maximum normalized autocorrelation value.

According to another aspect of the invention, an improvement of the proposed method is that the pitch search on the search border is handled with care, as described with respect to block 255 and with respect to FIGS. 4 and 5. If the lag value of Pitmin or Pitmax is chosen in some method, the algorithm is in danger of using a false lag value when the real maximum is outside the search range. This can even happen with a pitch search as described above, because the open loop and closed loop pitch search are working on different signal resolutions due to the Downsampling of the open loop pitch search. Therefore, this approach extends the search by a maximum of, for example, four samples above the corresponding border (in block 255). The pitch search stops and uses the corresponding lag value, if a first real maximum of the normalized autocorrelation is found outside the search range of [Pitmin Pitmax]. Otherwise, Pitmin−4 or Pitmax+4 is selected.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] 3GPP, TS 26.190, "Speech codec speech processing functions; Adaptive Multi-Rate—Wideband (AMR-WB) speech codec; Transcoding functions (Release 12)," 2014.

3GPP2, C.S0052-A, "Source-Controlled Variable-Rate Multimode Wideband Speech Codec (VMR-WB), Service Options 62 and 63 for Spread Spectrum Systems",Version 1.0, April 2005

3GPP, TS 26.445, "Universal Mobile Telecommunitations System (UMTS); LTE; Codec for enhanced Voice Services (EVS); Detailed algorithmic description", version 12.3.0, Release 12

[4] AAC-ELD Standard:
http://www.iso.org/iso/iso catalogue/catalogue tc/catalogue detail.htm?csnumber=46457

[5] EP0628947 "Method and device for speech signal pitch period estimation and classification in digital speech coders"

The invention claimed is:

1. An apparatus for determining a pitch information on the basis of an audio signal, wherein the apparatus is configured to acquire a similarity value (R(d); R'(d)) being associated with a given pair of portions of the audio signal comprising a given time shift (d);

wherein the apparatus is configured to choose a length (Len(d)) of signal portions of the audio signal used to acquire the similarity value (R(d); R'(d)) for the given time shift (d) in dependence on the given time shift (d);

where the apparatus is configured to choose the length (Len(d)) of the signal portions to be linearly dependent on the given time shift (d), within a tolerance of ±1 sample;

wherein the apparatus is configured to choose the length of the signal portions based on $$Len(d)=m\cdot d+\text{startlen}-Pit\text{min}\cdot m,$$

where d is the given time shift, startlen a predetermined minimum length for the signal portions, Pitmin a predetermined smallest considered pitch lag value and m a factor by which the given time shift is scaled, and wherein the apparatus is configured to choose the length of the signal portions as an integer value close to Len(d).

2. The apparatus according to claim 1, wherein the apparatus is configured to acquire a pitch information based on a sequence of similarity values.

3. The apparatus according to claim 2, wherein the apparatus is configured to acquire the sequence of similarity values based on similarity values for time shifts d in a range starting between 1 ms and 4 ms and extending up to time shifts between 15 ms to 25 ms.

4. The apparatus according to claim 1, wherein the apparatus is configured to step-wisely increase the length of the signal portions in steps of one sample with increasing time shift.

5. The apparatus according to claim 1, wherein the apparatus is configured to increase the length of the signal portions in integer precision with increasing time shift.

6. The apparatus according to claim 1, wherein the apparatus is configured to increase the length of the signal portions, between a predetermined minimum length and a predetermined maximum length, linearly in dependence of the given time shift, wherein the predetermined minimum length is used for a shortest time shift corresponding to a maximum pitch frequency, and wherein the predetermined maximum length is used for a longest time shift corresponding to a minimum pitch frequency.

7. The apparatus according to claim 1, wherein the apparatus is configured to compute an autocorrelation value (R'(d)) on the basis of two time shifted signal portions of the audio signal, time shifted by the given time shift (d), in order to acquire the similarity value, wherein a number of sample values of the audio signal considered in the computation of the autocorrelation value is determined by the chosen length.

8. The apparatus according to claim 7, wherein the apparatus is configured to acquire the similarity values based on $$R'(d)=\Sigma_{n=0}^{Len(d)}s(n)s(n-d),$$

where s(n) is a sample of the audio signal at time n, Len(d) is an information about the length of the signal portions for the given time shift d and d is the given time shift.

9. The apparatus according to claim 1, wherein the apparatus is configured to acquire a location information of a maximum value of a plurality of similarity values; and wherein the apparatus is configured to acquire a pitch information based on the location information of the maximum value.

10. The apparatus according to claim 1, wherein the apparatus is configured to apply a normalization to the similarity value (R'(d)) using at least two normalization values (norm(0), norm(d));

a first normalization value (norm(0)) representing a statistical characteristic of a first portion of the given pair of portions, and a second normalization value (norm(d)) representing a statistical characteristic of a second portion of the given pair of portions, in order to derive a normalized similarity value (R(d)).

11. The apparatus according to claim 10, wherein the apparatus is configured to acquire a normalized similarity value R(d) based on $$R(d)=\frac{R'(d)w(d)}{\sqrt{norm(0)norm(d)}},$$

where R'(d) is a similarity value and w(d) is a windowing function.

12. The apparatus according to claim 10, wherein the apparatus is configured to recursively derive a normalization value for a new time shift d, from a normalization value for a previous time shift d−1 by adding one or more energy values of signal samples comprised in a new signal portion and not comprised in an old signal portion and by subtracting one or more energy values of signal samples comprised in the old signal portion and not comprised in the new signal portion.

13. The apparatus according to claim 10, wherein the apparatus is configured to acquire a normalization value norm(d) based on $$\text{norm}(d)=\text{norm}(d-1)+x_d^2-x_{d+Len(d)}^2,$$

where $x_d$ is a sample of the audio signal comprised in the signal portion according to time shift d but not comprised in the signal portion according to time shift d−1, $x_{d+Len(d)}$ is a sample of the audio signal not comprised in the signal portion according to time shift d but comprised in the signal portion according to time shift d−1 of the audio signal and norm(d−1) is a normalization value acquired for a previously considered signal portion according to time shift d−1.

14. The apparatus according to claim 1, wherein the apparatus is configured to determine an information about a characteristic of an identified maximum of a sequence of similarity values (R(d); R'(d)) acquired for different time shifts (d); and wherein the apparatus is configured to provide a pitch frequency on the basis of the identified maximum if the information about the characteristic of the identified maximum indicates that the identified maximum is a local maximum; and wherein the apparatus is configured to proceed to consider one or more other similarity values for estimating the pitch frequency if the information about the characteristic of the maximum does not indicate that the maximum is a local maximum.

15. The apparatus according to claim 14, wherein the apparatus is configured to determine if an identified maximum is located at the border of the sequence of similarity values as the information about a characteristic of the identified maximum.

16. The apparatus according to claim 14, wherein the apparatus is configured to selectively consider one or more other similarity values beyond the border of the sequence of similarity values if the information about a characteristic of the identified maximum indicates that the identified maximum is located at the border of the sequence of similarity values.

17. The apparatus according to claim 1, wherein the apparatus is configured to determine a pitch information in an open-loop search or in a closed-loop search.

18. A method for determining a pitch information on the basis of an audio signal, comprising:

acquiring a similarity value (R(d); R'(d)) being associated with a given pair of portions of the audio signal comprising a given time shift (d);

choosing a length (Len(d)) of signal portions of the audio signal used to acquire the similarity value (R(d); R'(d)) for the given time shift (d) in dependence on the given time shift (d); and wherein the length (Len(d)) of the signal portions is chosen to be linearly dependent on the given time shift (d), within a tolerance of ±1 sample;

wherein the method comprises choosing the length of the signal portions based on $$Len(d)=m\cdot d+\text{startlen}-Pit\text{min}\cdot m,$$

where d is the given time shift, startlen a predetermined minimum length for the signal portions, Pitmin a predetermined smallest considered pitch lag value and m a factor by which the given time shift is scaled, and wherein the method comprises choosing the length of the signal portions as an integer value close to Len(d).

19. A non-transitory digital storage medium having stored thereon a computer program for performing a method for determining a pitch information on the basis of an audio signal, comprising:

acquiring a similarity value (R(d); R'(d)) being associated with a given pair of portions of the audio signal comprising a given time shift (d);

choosing a length (Len(d)) of signal portions of the audio signal used to acquire the similarity value (R(d); R'(d)) for the given time shift (d) in dependence on the given time shift (d); and wherein the length (Len(d)) of the signal portions is chosen to be linearly dependent on the given time shift (d), within a tolerance of ±1 sample;

wherein the method comprises choosing the length of the signal portions based on $$Len(d)=m\cdot d+\text{startlen}-Pit\text{min}\cdot m,$$

where d is the given time shift, startlen a predetermined minimum length for the signal portions, Pitmin a predetermined smallest considered pitch lag value and m a factor by which the given time shift is scaled, and wherein the method comprises choosing the length of the signal portions as an integer value close to Len(d), when said computer program is run by a computer.

20. An apparatus for determining a pitch information on the basis of an audio signal, wherein the apparatus is configured to acquire a similarity value (R(d); R'(d)) being associated with a given pair of portions of the audio signal comprising a given time shift (d);

wherein the apparatus is configured to choose a length (Len(d)) of signal portions of the audio signal used to acquire the similarity value (R(d); R'(d)) for the given time shift (d) in dependence on the given time shift (d);

where the apparatus is configured to choose the length (Len(d)) of the signal portions to be linearly dependent on the given time shift (d), within a tolerance of ±1 sample;

wherein the apparatus is configured to determine an information about a characteristic of an identified maximum of a sequence of similarity values (R(d); R'(d)) acquired for different time shifts (d); and wherein the apparatus is configured to provide a pitch frequency on the basis of the identified maximum if the information about the characteristic of the identified maximum indicates that the identified maximum is a local maximum; and wherein the apparatus is configured to proceed to consider one or more other similarity values for estimating the pitch frequency if the information about the characteristic of the maximum does not indicate that the maximum is a local maximum.

21. A method for determining a pitch information on the basis of an audio signal, comprising:

acquiring a similarity value (R(d); R'(d)) being associated with a given pair of portions of the audio signal comprising a given time shift (d);

choosing a length (Len(d)) of signal portions of the audio signal used to acquire the similarity value (R(d); R'(d)) for the given time shift (d) in dependence on the given time shift (d); and wherein the length (Len(d)) of the signal portions is chosen to be linearly dependent on the given time shift (d), within a tolerance of ±1 sample;

wherein the method comprises determining an information about a characteristic of an identified maximum of a sequence of similarity values (R(d); R'(d)) acquired for different time shifts (d); and wherein the method comprises providing a pitch frequency on the basis of the identified maximum if the information about the characteristic of the identified maximum indicates that the identified maximum is a local maximum; and wherein the method comprises proceeding to consider one or more other similarity values for estimating the pitch frequency if the information about the characteristic of the maximum does not indicate that the maximum is a local maximum.

22. A non-transitory digital storage medium having stored thereon a computer program for performing a method for determining a pitch information on the basis of an audio signal, comprising:

acquiring a similarity value (R(d); R'(d)) being associated with a given pair of portions of the audio signal comprising a given time shift (d);

choosing a length (Len(d)) of signal portions of the audio signal used to acquire the similarity value (R(d); R'(d)) for the given time shift (d) in dependence on the given time shift (d); and wherein the length (Len(d)) of the signal portions is chosen to be linearly dependent on the given time shift (d), within a tolerance of ±1 sample;

wherein the method comprises determining an information about a characteristic of an identified maximum of a sequence of similarity values (R(d); R'(d)) acquired for different time shifts (d); and wherein the method comprises providing a pitch frequency on the basis of the identified maximum if the information about the characteristic of the identified maximum indicates that the identified maximum is a local maximum; and wherein the method comprises proceeding to consider one or more other similarity values for estimating the pitch frequency if the information about the characteristic of the maximum does not indicate that the maximum is a local maximum, when said computer program is run by a computer.

* * * * *